US006505590B1

(12) United States Patent
Rao et al.

(10) Patent No.: US 6,505,590 B1
(45) Date of Patent: Jan. 14, 2003

(54) DESMODROMIC VALVE DESIGNS FOR IMPROVED OPERATION SMOOTHNESS, STABILITY AND PACKAGE SPACE

(75) Inventors: V. Durga Nageswar Rao, Bloomfield Hills, MI (US); Gary Allan Vrsek, Brighton, MI (US); Josef Wandeler, Milford, MI (US); Yash Andrew Imai, Troy, MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/682,258

(22) Filed: Aug. 10, 2001

(51) Int. Cl.[7] ..... F01L 1/30

(52) U.S. Cl. ..... 123/90.24; 123/90.25; 123/90.26; 123/90.6

(58) Field of Search ..... 123/90.24, 90.25, 123/90.26, 90.1, 90.6, 90.49, 90.52, 90.53, 90.54

(56) References Cited

U.S. PATENT DOCUMENTS

| | | | | |
|---|---|---|---|---|
| 1,111,169 A | | 9/1914 | Mueller | |
| 1,490,656 A | | 4/1924 | Bignan | |
| 2,751,789 A | | 6/1956 | Orenick | |
| 3,492,880 A | | 2/1970 | Pearson | |
| 4,337,699 A | | 7/1982 | Beisel | |
| 4,457,268 A | * | 7/1984 | Jones | 123/90.23 |
| 5,099,805 A | | 3/1992 | Ingalls | |
| 5,327,856 A | | 7/1994 | Schroeder et al. | |
| 5,544,628 A | * | 8/1996 | Voigt | 123/198 F |
| 5,598,814 A | | 2/1997 | Schroeder et al. | |

FOREIGN PATENT DOCUMENTS

| | | |
|---|---|---|
| GB | 22822 | 10/1911 |

* cited by examiner

*Primary Examiner*—Thomas Denion
*Assistant Examiner*—Jaimie Corrigan

(57) ABSTRACT

A desmodromic drive (30) for imparting reciprocal translation to a valve (32) has a cam ring (52) that rotates about an axis (42), a follower (50) that reciprocates with axial motion as the ring rotates, an endless cam track (69) on the ring, and rollers (76, 78) on the follower that ride along the cam track as the ring rotates. A follower guide (48) guides the follower for axial. Rollers (60, 62) constrain the follower against rotation on the follower guide.

21 Claims, 8 Drawing Sheets

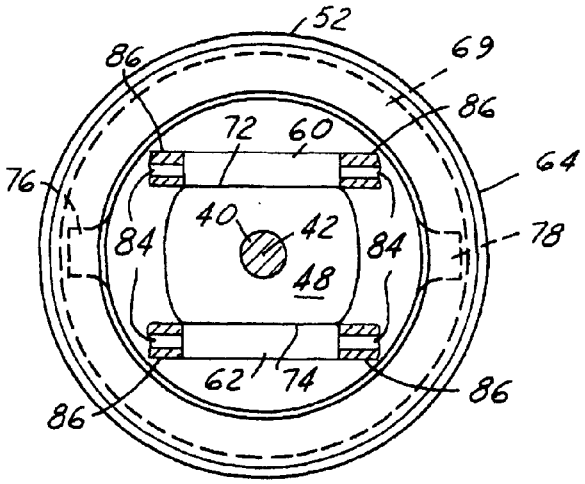
FIG. 2
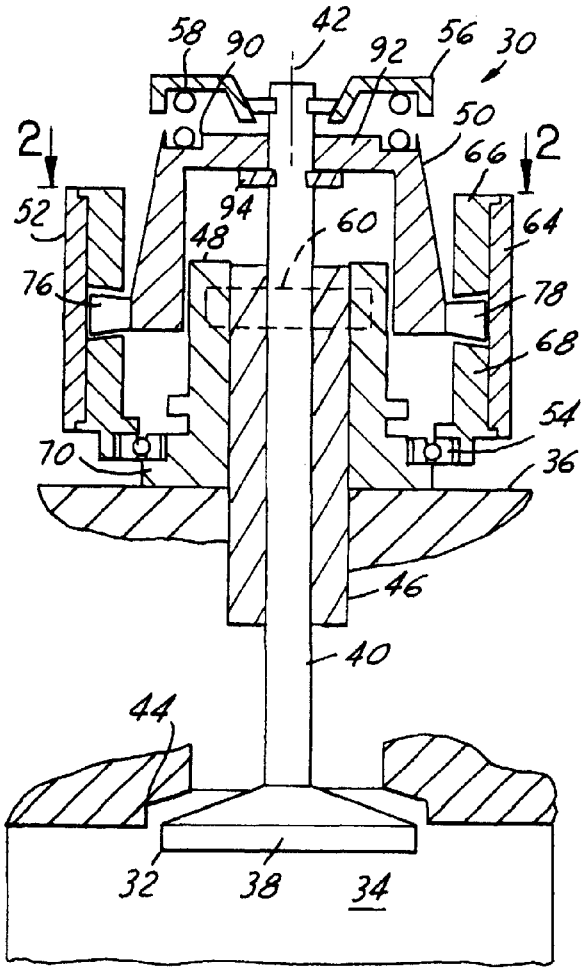
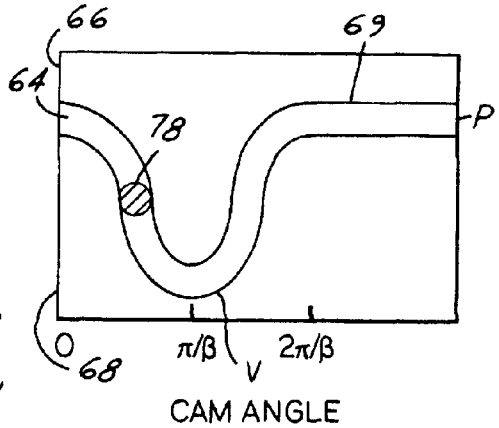
FIG. 3
FIG. 1

DESMODROMIC VALVE DESIGNS FOR IMPROVED OPERATION SMOOTHNESS, STABILITY AND PACKAGE SPACE

BACKGROUND OF THE INVENTION

This invention relates generally to drive mechanisms that convert uni-directional rotational motion to reciprocal translation. An example of such a mechanism is a desmodromic drive, one use of which is as an actuator of an intake and/or an exhaust valve in an internal combustion engine.

A search conducted in connection with this invention developed U.S. Pat. Nos. 1,111,169; 1,490,656; 2,751,789; 3,492,880; 4,337,699; 5,099,805; 5,327,856; and 5,598,814; and U.K. Provisional Specification 22,822. Several of those patents are concerned with operation of engine intake and/or exhaust valves. Unlike a spring-biased engine valve that is forced open by a camshaft lobe and that relies on the spring force to close the valve, a desmodromic valve actuator assures both positive valve opening and positive valve closing.

At high engine speeds, a desmodromic actuator can be effective to prevent valve float that could otherwise when only spring force is used to close the valve. Hence, it is known to employ desmodromic valve actuators to operate valves of motorcycle engines whose top speeds can be much in excess of those typical of passenger car engines.

SUMMARY OF INVENTION

The present invention relates to novel desmodromic mechanisms, especially mechanisms for operating a valve such as an engine intake or exhaust valve. Various embodiments of novel mechanisms possessing various novel features are disclosed. The mechanisms are intended to provide both the performance, the efficiency, and the durability that are needed for use in the harsh environment of an automotive vehicle engine within the confines of limited space.

One generic aspect of the invention relates to a desmodromic drive for imparting reciprocal translation to a translatable member. The drive comprises a ring that rotates about an axis, a follower that reciprocates with straight line motion along the axis as the ring rotates for imparting reciprocal translation to the member, and a coupling of the ring to the follower that causes the follower to reciprocate along the axis as the ring rotates. The coupling comprises an endless cam track on one of the ring and the follower and an element on the other of the ring and the follower that rides along the cam track as the ring rotates. A follower guide guides the follower for axial motion along the axis. The drive includes a roller that defines a circumferential relation of the follower to the follower guide about the axis. The roller may be either a circular cylinder or a sphere.

Another aspect relates to a desmodromic drive for imparting reciprocal translation to a valve element of a valve. The drive has a ring, a follower, a coupling, and a follower guide, as described above, and a feature that defines a circumferential relation of the follower to the follower guide about the axis. The valve has a stem through which the reciprocation of the follower imparts reciprocal translation to the valve element. A spiral wave spring biases the stem relative to the follower to allow for lost-motion over-travel of the follower relative to the stem.

Still another aspect relates to a desmodromic drive mechanism that imparts reciprocal translation to a valve element of a valve. The mechanism comprises a ring, a follower, a coupling, a follower guide, a feature that defines a circumferential relation of the follower to the follower guide about the axis, and a stem, as described above. The valve element closes against the valve seat concurrent with the element that rides along the cam track riding along a certain segment of the cam track. The follower comprises a central hub concentric with the axis and an arm that extends radially outward from the hub to the element that rides along the cam track, and the arm is arranged to flex as the element that rides along the cam track rides along the certain segment of the cam track and thereby cause the valve element to be forced against the valve seat when the valve element closes against the valve seat.

Still another aspect relates to a desmodromic drive for imparting reciprocal translation to a translatable member and comprising a ring, a follower, a coupling, and a follower guide. The follower comprises a central hub concentric with the axis and two pairs of arms that extend radially outward from the hub. A first pair of the arms extend in opposite directions to respective elements that ride along an endless cam track on the ring. The cam track comprises two identical segments each running along a respective semi-circumference of the ring. The follower guide comprises two axially extending grooves that are disposed facing and diametrically opposite each other about the axis and circumferentially between the two arms of the first pair. Each arm of a second pair of the arms extends from the hub toward a respective one of the two grooves of the follower guide and carries a respective sphere that is spring-biased radially outwardly of the axis to ride in the respective groove as the follower axially reciprocates.

Further aspects will be seen in various features of presently preferred embodiments of the invention that will be described in detail.

BRIEF DESCRIPTION OF DRAWINGS

The drawings that will now be briefly described are incorporated herein to illustrate a preferred embodiment of the invention and a best mode presently contemplated for carrying out the invention.

FIG. 1 front elevation view in cross section through a first exemplary embodiment of desmodromic drive mechanism for operating an engine valve, according to the invention.

FIG. 2 is a full cross section view taken generally along line 2—2 in FIG. 1.

FIG. 3 is a developed view of a portion of FIG. 1.

DETAILED DESCRIPTION

Figure 5:
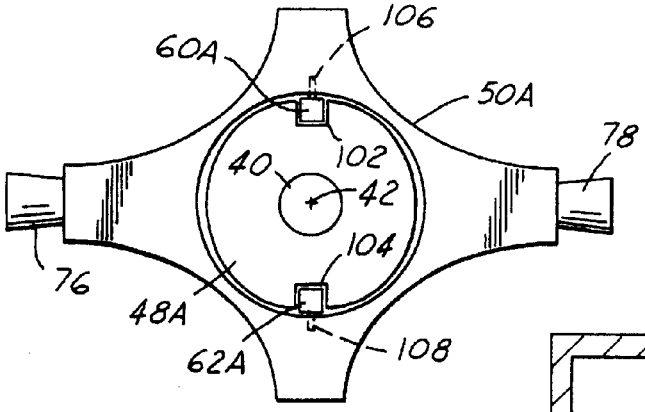
FIG. 5 is a full top plan view of FIG. 4.

FIGS. 1 and 2 show a desmodromic drive mechanism 30 that operates a valve 32 associated with a cylinder 34 of an internal combustion engine. Valve 32 is representative of either an intake valve that allows intake flow into cylinder 34 at a proper intake time during an engine operating cycle or an exhaust valve that allows exhaust flow from cylinder 34 at a proper exhaust time during the engine cycle. Valve 32 mounts on a cylinder head 36 of the engine and comprises a head 38 and a stem 40 that extends centrally from head 38 along an imaginary centerline, or axis, 42. Valve 32 is positionable along axis 42 to allow flow with respect to cylinder 34 when head 38 is unseated from a valve seat 44, as shown, and to disallow flow when head 38 closes on seat 44. The lower portion of a circular cylindrical guide sleeve 46 is fit to a mounting hole in cylinder head 36. Sleeve 46 engages stem 40 to guide valve 32 for reciprocal translation along axis 42.

Mechanism 30 comprises a follower guide 48, a follower 50, a cam ring 52, a bearing assembly 54, a spring retainer 56, a spring 58, and two rollers 60, 62. Cam ring 52 is itself composed of three ring-shaped parts 64, 66, and 68. Part 64 is an outer circular cylindrical ring that provides a mounting for parts 66 and 68 on its inner face. The lower edge of part 66 and the upper edge of part 68 are profiled to cooperatively define an endless cam track 69 of cam ring 52. The developed shape of one-half of cam track 69 is shown in FIG. 3.

Follower guide 48 is generally cylindrical in shape and concentric with axis 42. Follower guide 48 fits over an upper portion of guide sleeve 46 on the exterior of cylinder head 36 and comprises a base 70 that is disposed against an outer top wall of cylinder head 36. Base 70 has a circular ledge, or shoulder, supporting an inner race of bearing assembly 54 concentric with axis 42. The lower edge of part 68 of cam ring 52 comprises a shoulder that fits to an outer race of bearing assembly 54 thereby supporting cam ring 52 on follower guide 48 for rotation about axis 42. Above base 70, the circumference of follower guide 48 is rendered non-circular by opposite flat, mutually parallel outer faces 72, 74 that are also parallel with axis 42.

Follower 50 has a shape for fitting over follower guide 48 concentric with axis 42. Tapered rollers 76, 78 protrude from diametrically opposite locations on follower 50 to enter cam track 69, which has a taper complementary to that of the two rollers. Rollers 60, 62 are disposed on follower 50 diametrically opposite each other. Each roller 60, 62 has a circular cylindrical shape and is supported for rotation about a respective axis that is parallel with the diameter on which rollers 76, 78 are centered. As will become more apparent from ensuing description, rollers 60, 62 are arranged to tangentially confront and roll along faces 72, 74 of follower guide 48 so as to constrain follower 50 against turning on follower guide 48 about axis 42 as rotation of cam ring 52 about axis 42 imparts reciprocating motion to follower 50 along axis 42. Because rollers 60, 62 can roll along faces 72, 74, follower 50 can enjoy low-friction reciprocating motion on follower guide 48 without turning about axis 42 as mechanism 30 operates valve 32. Rollers 60, 62 are carried by follower 50 via respective pins 84 that pass through apertured ears 86 on follower 50.

Spring retainer 56 is centrally secured to the far end of stem 40 over follower 50. Spring 58 is seated between spring retainer 56 and a circular groove 90 in a top circular wall 92 of follower 50. At the opposite side of wall 92, a ring 94 that locks onto stem 40 is resiliently biased against wall 92 by the action of spring 58 on valve 32. FIG. 1 shows that some axial lost-motion is provided between valve 32 and follower 50 so that follower 50 can overtravel valve 32 once valve head 38 seats closed on seat 44. The overtravel is taken up by compression of spring 58 between spring retainer 56 and follower 50.

Cam track 69 comprises two identical segments each running along a respective semi-circumference of cam ring 52. FIG. 3 shows an example of one segment. While one of the two rollers 76, 78 is traveling along this track segment as cam ring 52 rotates, the other roller is traveling along the other track segment at exactly the same point along the track segment. For example, if roller 78 were at the point shown in FIG. 3, roller 76 would be at the same point of the other track segment.

As cam ring 52 rotates, each roller is constrained to follow cam track 69. Each segment of the track is designed with an identical throw that sets the range of travel for follower 50 in the direction of axis 42. In FIG. 3, the throw appears as a valley V that extends downward from a horizontal plateau P in track 69.

Assuming that cam ring 52 is rotating counterclockwise in FIG. 2, corresponding to movement of roller 78 to the right along track 69 in FIG. 3, the lower edge of part 66 is acting on roller 78 in a manner that forces the roller downward. The other segment of the track is acting on roller 76 in the same way. Hence, a resultant force acts on valve 32 to move the valve downward more fully unseating from seat 44. When cam ring 52 has rotated sufficiently that rollers 76, 78 are at the bottoms of the respective valleys in track 69, valve 32 is maximally open. Continued rotation of cam ring 52 now causes the upper edge of each part 68 to act on the respective rollers 76, 78 to force follower 50 to climb the right-hand slopes of valleys V as viewed in FIG. 3 for roller 78, thereby moving valve 32 toward closed position. As the rollers approach the plateaus P of track 69, valve head 38 closes on seat 44. A small amount of overtravel is designed into the throw of track 69 so that once valve 32 seats closed, follower 50 will continue to move upward, compressing spring 58 slightly as it does. In this way spring 58 imparts a closing force that is maintained on the seated valve head 38 while valve 32 remains closed and the respective rollers continue to travel along the respective plateau segments of the cam track. Valve 32 continues to be forced closed until cam ring 52 has rotated sufficiently that rollers 76, 78 once again encounter the downslopes of valleys V, at which time valve 32 will re-open.

Cam ring 52 may be rotated by any suitable engine mechanism that correlates cam ring rotation with engine operating cycle to cause the valve to operate at proper times during the cycle. Reciprocal motion is imparted to follower 50, and hence valve 32, only during a portion of the engine cycle when the valve is to open; otherwise the valve remains closed.

Figure 4:
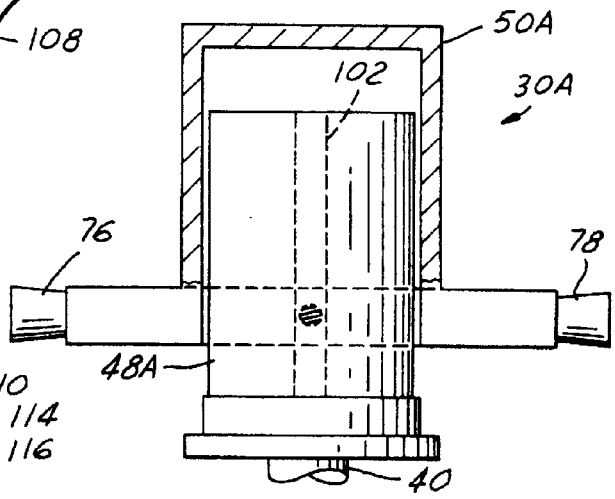
FIG. 4 is a view similar to FIG. 1 showing a portion of a second embodiment.

FIGS. 4 and 5 show a follower 50A and a follower guide 48A of a second embodiment of mechanism 30A that differs from mechanism 30 in how the follower guide guides the follower. Follower guide 48A has grooves 102, 104 that run lengthwise parallel to axis 42 diametrically opposite each other in the follower guide circumference at 90° to the common centerline of rollers 76 and 78. Follower 50A is somewhat hat-shaped and comprises a cylindrical side wall that carries two rollers 60A, 62A diametrically opposite each other. Each roller 60A, 62A is arranged to travel in a respective groove 102, 104 and is supported on a respective shaft 106, 108 for rotation about a common centerline that is at 90° to the common centerline of rollers 76 and 78. Each groove 102, 104 is generally rectangular in cross section and has a width just slightly larger than the diameter of the respective roller 60A, 62A so that the rollers are captured between confronting sides of the grooves. Shafts 106, 108 fit in holes in follower 50A, and rollers 60A, 62A fit onto the ends of the shafts that protrude at the inside of the follower side wall. Mechanism 30A operates in the same manner as mechanism 30 with rollers 60A, 62A preventing follower 50A from turning on follower guide 48A about axis 42 as cam ring 52 rotates.

Figure 7:
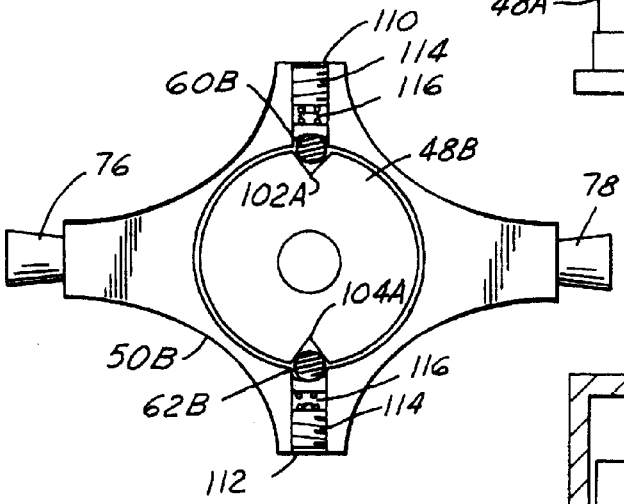
FIG. 7 is a full top plan view of FIG. 6.
Figure 6:
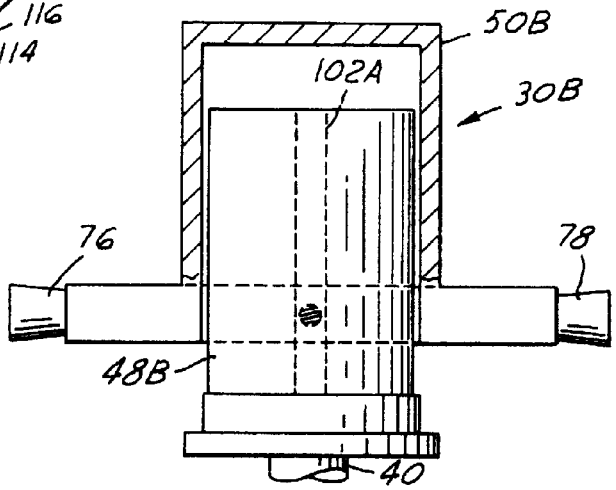
FIG. 6 is a view similar to FIG. 1 showing a portion of a third embodiment.
Figure 8:
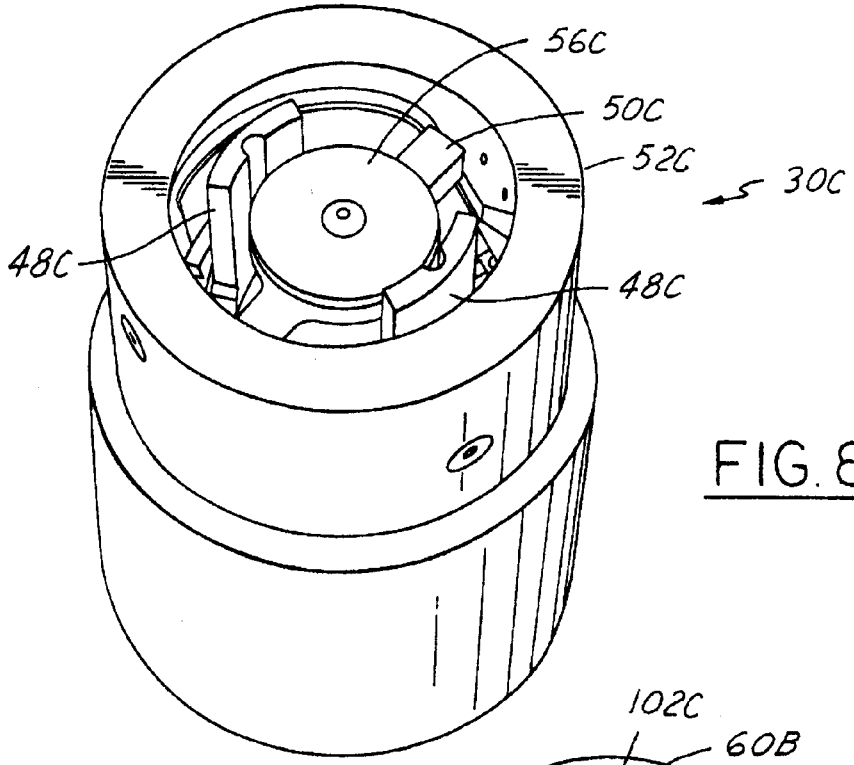
FIG. 8 is a perspective view of a fourth embodiment.
Figure 9:
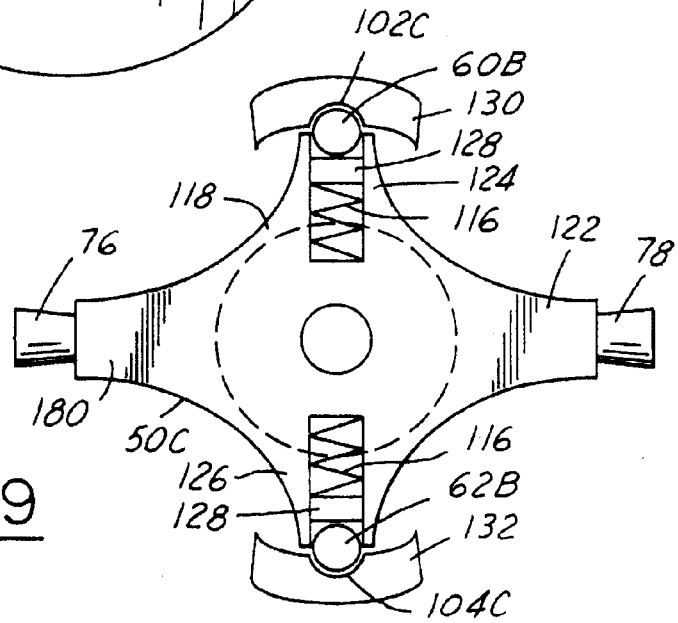
FIG. 9 is a top plan view, partly in section, of a portion of the mechanism of FIG. 8.
Figure 10:
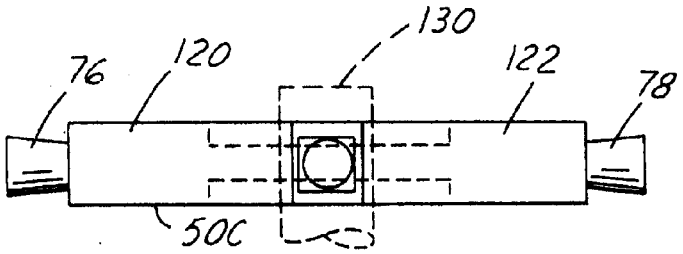
FIG. 10 is a front elevation view of FIG. 9.

FIGS. 6 and 7 show a follower 50B and a follower guide 48B of a third embodiment of mechanism 30B that differs from mechanisms 30 and 30A in how the follower guide guides the follower. Follower guide 48B has V-shaped grooves 102A, 104A that run lengthwise parallel to axis 42 diametrically opposite each other in the follower guide circumference at 90° to the common centerline of rollers 76 and 78. Like follower 50A, follower 50B is somewhat hat-shaped and comprises a cylindrical side wall that carries two rollers 60B, 62B diametrically opposite each other. Unlike rollers 60A, 62A, rollers 60B, 62B are spheres. Each sphere 60B, 62B is arranged to roll along a respective groove 102A, 104A. A respective spring-bias mechanism 110, 112 spring biases each sphere radially inward toward seating the sphere in the respective groove. Each spring-bias mechanism comprises a set screw 114 that is threaded into a hole in follower 50B and a small spring 116 that is disposed between the set screw and the sphere. The set screw can be adjusted to impart desired bias force to the sphere. Alternatively, spring 116 may be eliminated so that a set screw will act directly on a sphere, without imparting spring bias to the sphere. Mechanism 30B operates in the same manner as mechanisms 30 and 30A with spheres 60B, 62B rolling along up and down along the grooves while preventing follower 50B from turning on follower guide 48B about axis 42 as cam ring 52 rotates.

FIGS. 8–15 show a fourth embodiment of mechanism 30C that differs from mechanisms 30, 30A, and 30B in a number of respects. Mechanism 30C comprises a cam ring 52C and a follower 50C. It also comprises a follower guide 48C with which the circular cylindrical guide sleeve for the valve stem is integrated so that the two form a single part. The inner race of bearing assembly 54 is supported on a shoulder of a base 70C of follower guide 48C and cam ring 52C is supported on the outer bearing assembly race. A guide sleeve 46C extends downward from a central region of base 70C to guide valve stem 40.

Follower 50C comprises a central hub 118 and a pair of arms 120, 122 that extend radially of axis 42 in opposite directions from hub 118. Rollers 76, 78 are disposed at the ends of respective arms 120, 122. Follower 50C comprises a second pair of arms 124, 126 that extend radially of axis 42 in opposite directions from hub 118 at 90° to the common centerline of rollers 76, 78. Spheres 60B, 62B are carried by follower 50C at the ends of the respective arms 124, 126. Each sphere is biased radially outward of the respective arm into a respective groove 102C, 104C.

Grooves 102C, 104C run lengthwise parallel to axis 42 diametrically opposite each other centrally along the radially inner concave faces of posts 130, 132 that extend upright from base 70C in follower guide 48C. Hence, the grooves are also at 90° to the common centerline of rollers 76 and 78. Spring-bias is imparted to each sphere by a respective spring 116 disposed in a blind hole in the end of the respective arm 124, 126. The spring force may be imparted to a sphere through a bearing element 128.

Mechanism 30C comprises circular spring retainers 56C and 57C confronting opposite faces of hub 118. Each spring retainer is affixed to valve stem 40 to allow bi-directional lost-motion overtravel of follower 50C relative to valve 32. A first spring 58C is disposed between spring retainer 56C and one face of hub 118, and a second spring between spring retainer 57C and the opposite hub face. Springs 58C are spiral wave springs like the one shown by itself in FIG. 15. Such springs provide desired spring force characteristics while saving space in the axial direction. They also serve as a lash adjusting mechanism and provide relatively quiet operation.

Figure 11:
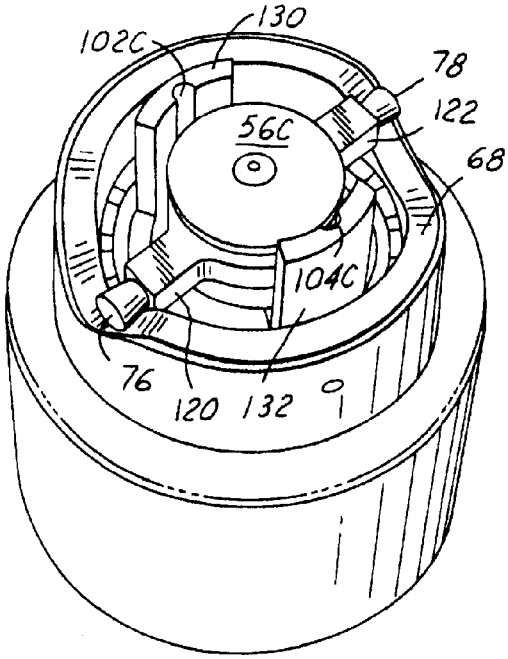
FIG. 11 is a view similar to FIG. 8, but with certain parts cut away for illustration.
Figure 12:
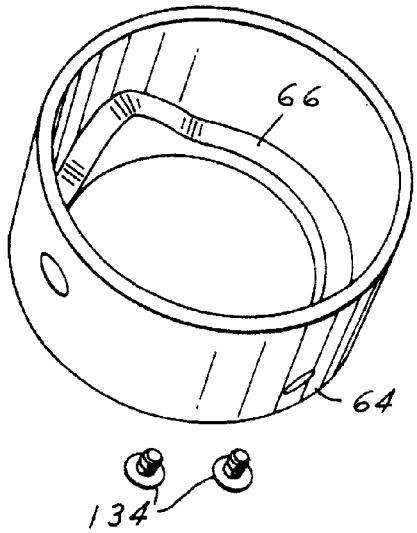
FIG. 12 is a perspective view of parts cut away from FIG. 11.
Figure 13:
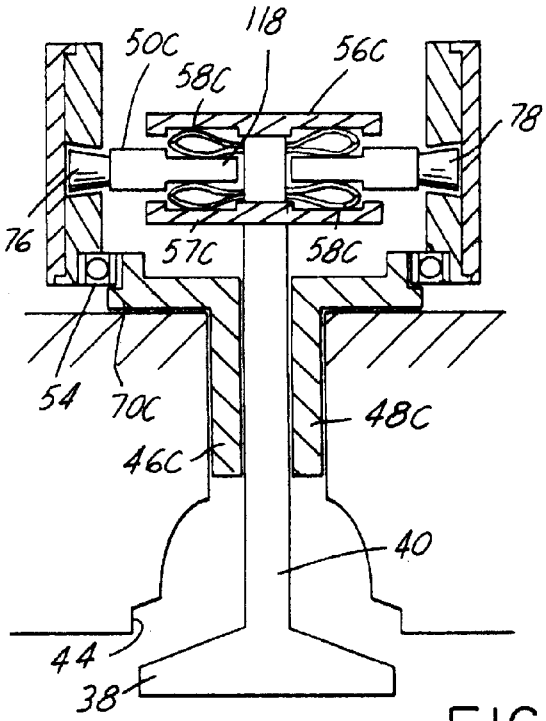
FIG. 13 is a view of the fourth embodiment in the same direction as the view of FIG. 1.
Figure 14:
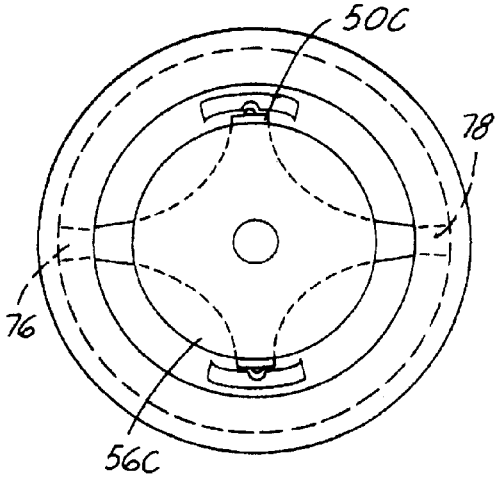
FIG. 14 is a view of the fourth embodiment in the same direction as the view of FIG. 2.
Figure 15:
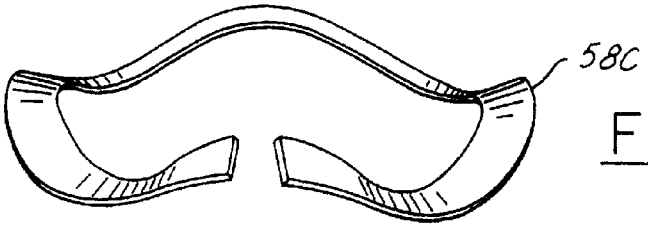
FIG. 15 is a perspective view of one of the parts of the fourth embodiment by itself.

FIG. 12 shows ring 64 containing part 66, and FIG. 11 shows part 68. Fasteners 134 are screws that pass through holes in the side wall of ring 64 and thread into holes in the side wall of part 68.

Mechanism 30C operates in the same manner as the pervious mechanisms with spheres 60B, 62B rolling along up and down along grooves 102, 104 while preventing follower 50C from turning on follower guide 48C about axis 42 as cam ring 52C rotates.

Figure 16:
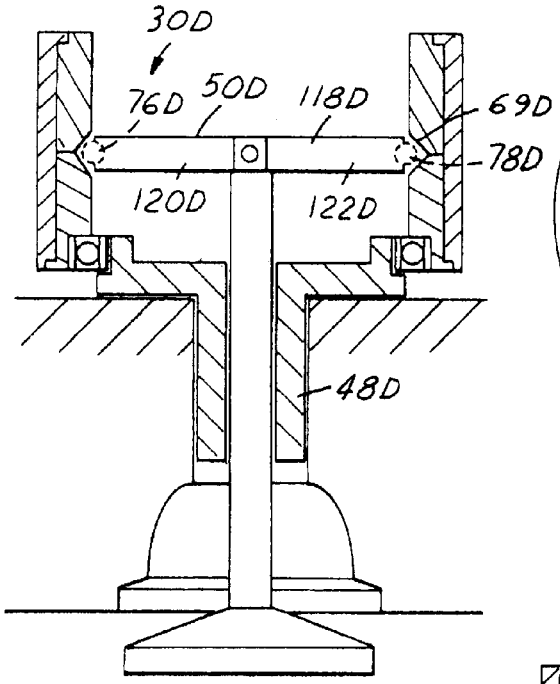
FIG. 16 is a view of a fifth embodiment in the same direction as the view of FIG. 1.
Figure 17:
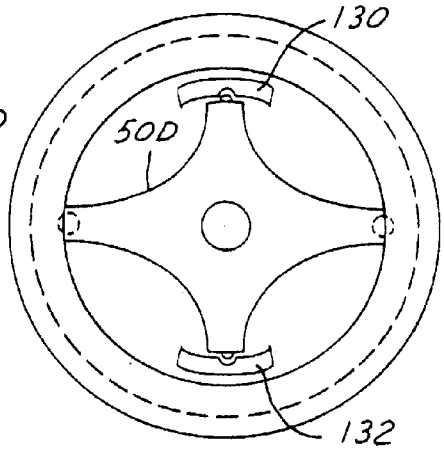
FIG. 17 is a view of the fifth embodiment in the same direction as the view of FIG. 2.
Figure 18:
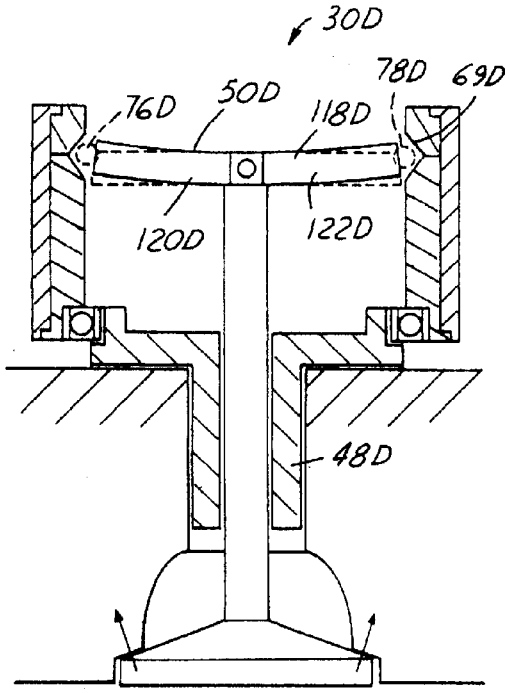
FIG. 18 is a view like FIG. 16, but showing the position of the mechanism at a different portion of an engine cycle.

FIGS. 16–18 show a follower 50D and a follower guide 48D of a fifth embodiment of mechanism 30D that is somewhat similar to mechanism 30C but differs in several respects. In particular, mechanism 30D comprises spheres 76D, 78D at the ends of arms 120D, 122D. Cam ring 52D comprises a cam track 69D that has a V-shape cross section along which spheres 76D, 78D roll as the cam ring rotates. Arms 120D, 122D are arranged to flex slightly, in the manner of a cantilever, as follower 50D overtravels the valve once the valve is seated closed. The flexing that occurs during overtravel is readily seen in FIG. 18. This arrangement allows valve stem 40 to be attached directly to hub 118D of follower 50D. As the arms flex, closing force is applied to seat the valve head closed. This construction allows spring retainers 56C, 57C and the respective springs 58C to be eliminated. Follower guide 48D is like follower guide 48C and includes the grooved posts 130, 132.

Figure 19:
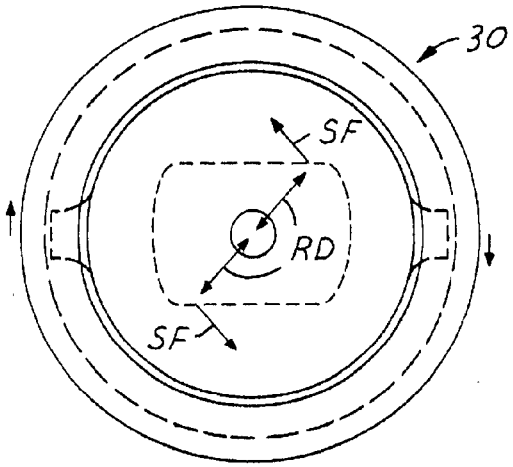
FIG. 19 is a view like FIG. 2, but with arrows as explanatory symbols.
Figure 20:
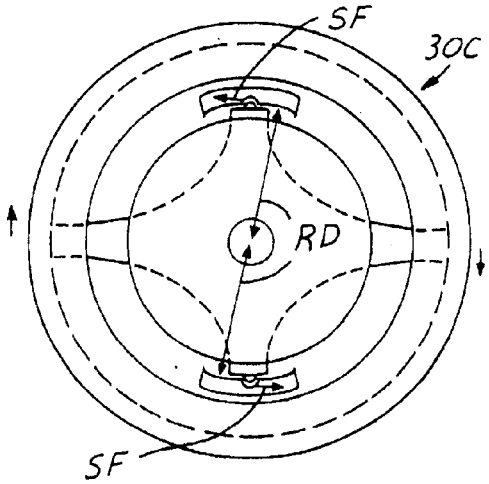
FIG. 20 is a view like FIG. 14, but with arrows as explanatory symbols.

In all embodiments, rotation of the cam ring tends to turn the follower, and that is why circumferential relation of the follower to the follower guide is provided. In all disclosed embodiments, that relation constrains the follower against any rotation. It has been found beneficial to place the points of constraint at the largest radial distance from axis 42 consistent with available space for the mechanism. FIG. 19 is a force diagram for an embodiment like mechanism 30, and FIG. 20, a force diagram for an embodiment like mechanism 30C. For a given turning torque applied to the respective follower, the side force SF on the circumferential constraint decreases as the radial distance RD at which it is applied increases. The side force correlates with the frictional force that resists axial movement of the follower, and hence lower frictional forces may be expected with an embodiment like mechanism 30C.

Figure 21:
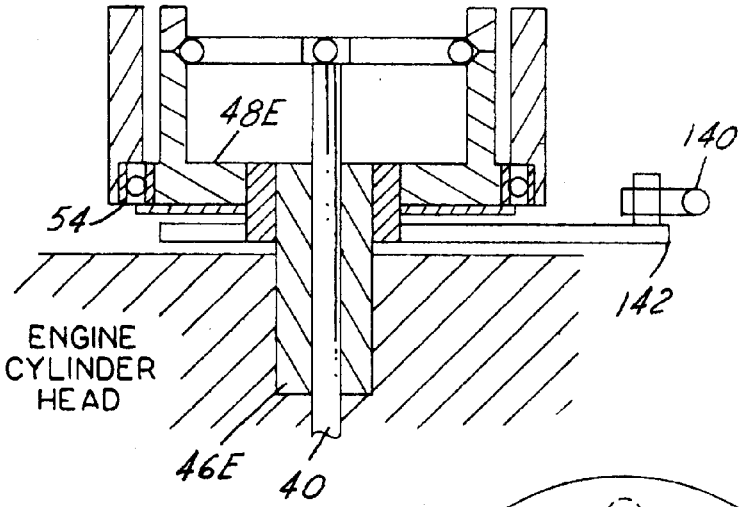
FIG. 21 is an elevation view, in cross section, of a desmodromic drive mechanism that provides variable phasing of valve operation.
Figure 22:
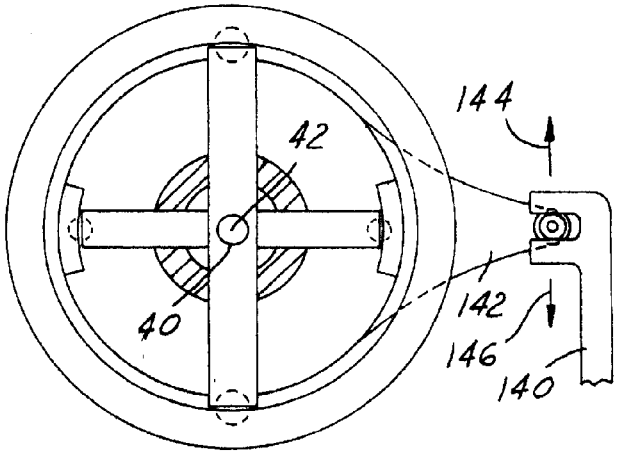
FIG. 22 is a full top plan view of FIG. 21.

The mechanisms that have been described offer the possibility of varying the phasing of valve opening by varying the phasing of the follower guide and hence that of the follower about axis 42 relative to the phase of the cam track of the cam ring. FIGS. 21 and 22 show an embodiment similar to the one of FIG. 18, but differing in that follower guide 48E is arranged to turn on guide sleeve 46E about axis 42. Turning of follower guide 48E about a limited number of angular degrees is performed by a link 140 that has an operative connection to the end of an arm 142 that is affixed to follower guide 48E. Moving link 140 in the general direction of arrow 144 turns follower guide 48E counterclockwise while moving the link in the opposite direction of arrow 146 turns follower guide 48E clockwise. This capability enables various changes in valve opening and closing to be performed. Representative examples are given in FIGS. 23A, 23B, 23C, and 23D.

If link 140 does not move from the solid line position of FIG. 22, the valve motion is like that shown by the solid line trace in each FIGS. 23A, 23B, 23C, and 23D which depicts valve opening as a function of the rotational position of the cam ring. The point marked 50 is the start of valve opening. From there the valve increasingly opens, achieving maximum opening at point FO. From point FO, the valve begins closing, becoming fully closed at point FC. By moving link 140 in various ways, the valve opening and closing motions may be phased in various ways.

Figure 23A:
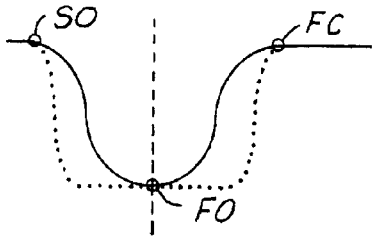
FIGS. 23A, 23B, 23C, and 23D diagrams that show various valve phasing.

FIG. 23A shows a more rapid opening action and a more rapid closing action that result in the valve being fully open for a larger angular extent of cam ring rotation than when the follower guide does not turn. Motion represented by the broken line trace is achieved by moving link 140 in the direction of arrow 146 to turn follower guide 48E clockwise as the counterclockwise turning cam ring begins to open the valve, then once the valve has fully opened, reversing the motion of the link to cause the follower guide to turn counterclockwise at the same rate as the cam ring and thereby keep the valve fully open, and then reversing the link motion to close the valve rapidly by turning the follower guide clockwise against the counterclockwise turning cam follower. The rate at which the follower guide is turned relative to the rate of cam ring turning as the valve moves from closed to open and from open to closed controls the angular extent of cam ring rotation for which the valve is fully open and how quickly the valve opens and closes.

Figure 23B:
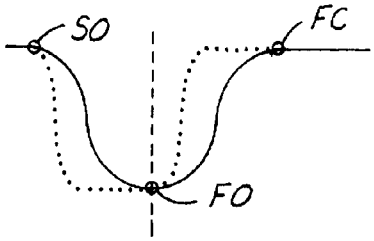

FIG. 23B shows, by a broken line trace, a second variation. The operation is like that shown by FIG. 23A except that here the phase of the second reversal of link motion that begins to close the valve is advanced from the example of FIG. 23A. Upon the valve attaining full closure, the link motion changes to keep the valve closed while returning the link to a proper initial position for the next valve opening cycle.

Figure 23C:
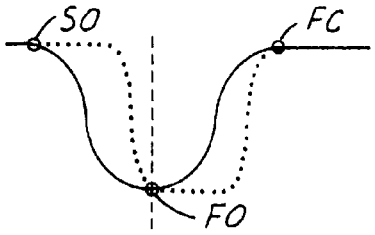

FIG. 23C shows, by broken line trace, a third variation that like the example of FIG. 23B except that the directions of link motion are reversed. This results in retarded valve opening and closing rather than advanced valve opening and closing as in the FIG. 23B example.

Figure 23D:
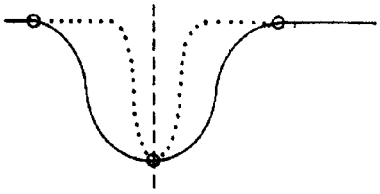

FIG. 23D shows, by broken line trace, a fourth variation having a delayed, and more rapid, opening action and an accelerated, and more rapid, closing action that result in the valve being fully open for a shorter angular extent of cam ring rotation than when the follower guide does not turn. This is achieved by moving link 140 in the direction of arrow 148 to turn follower guide 48E counterclockwise at the same rate as the counterclockwise turning cam ring when the cam ring would otherwise begin to open the valve. The link motion is reversed to turn the follower guide clockwise and rapidly move the valve to fully open and then fully closed. Upon the valve becoming fully closed, the link motion is changed as needed to keep the valve closed while placing the link in initial proper position for the next valve opening cycle.

Figure 24:
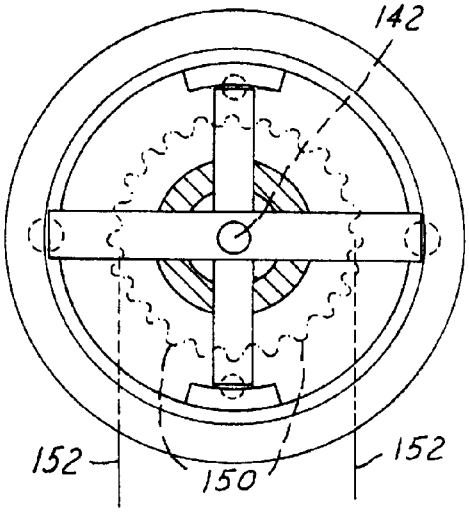
FIG. 24 is a top plan view similar to FIG. 22 showing a modified form.
Figure 25:
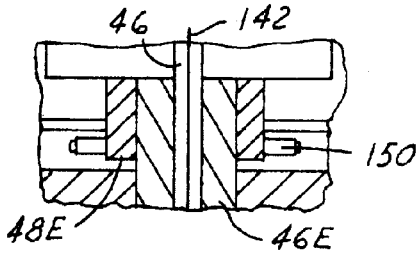
FIG. 25 is a view in the same direction as FIG. 21 showing the modified form of FIG. 24.

FIGS. 24 and 25 show another mechanism for valve phasing. A sprocket wheel 150 is affixed to follower guide 48E concentric with axis 42. A chain 152 that wraps around the sprocket wheel as shown and can be moved in opposite senses by a prime mover, not shown, can turn the sprocket wheel, and hence follower guide 48E, in opposite senses about axis 42, analogous to the turning of follower guide 48E by link 140 and arm 142.

Figure 26:
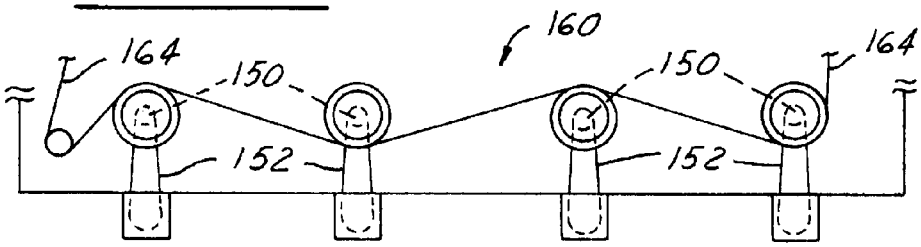
FIG. 26 is a top plan view of a portion of an actuating mechanism for multiple desmodromic valve mechanisms on an engine.

FIG. 26 shows a valve actuating mechanism 160 of an internal combustion engine 162. Each of four desmodromic drive mechanisms operates a respective valve associated with a respective cylinder of engine 162. Each drive mechanism has a phasing mechanism comprising a sprocket wheel 150 and chain 152 like the mechanism in FIGS. 24 and 25. The cam rings of the respective desmodromic mechanisms are rotated in unison by an endless chain 164 that may be driven by the engine crankshaft and that meshes with sprocket wheels affixed to the cam rings.

Figure 27:
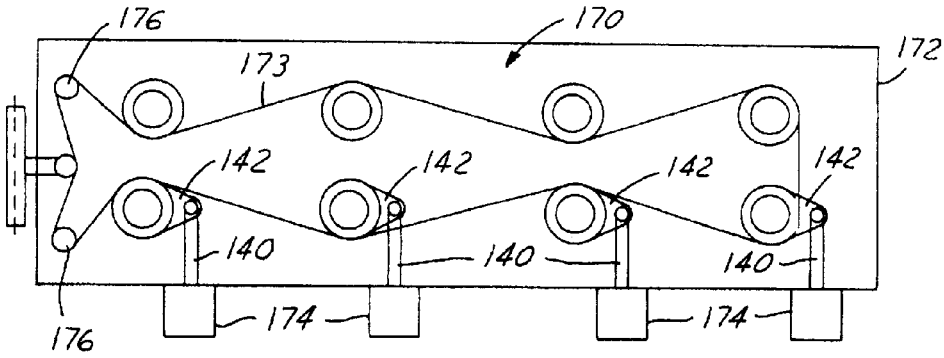
FIG. 27 is a plan view of another actuating mechanism on an engine.

FIG. 27 shows another valve actuating mechanism 170 for an engine 172. Each of eight desmodromic drive mechanisms operates a respective valve associated with a respective cylinder of engine 172. The cam rings of the respective desmodromic mechanisms are rotated in unison by an endless chain 174 that is driven by the engine crankshaft and that meshes with sprocket wheels affixed to the cam rings. One half of the drive mechanisms have phasing mechanisms each comprising a link 140 and arm 142 like the mechanism in FIGS. 21 and 22. Each link 140 is operated by a respective prime mover 174. While engine 172 has two types of valves (intake and exhaust) associated with each cylinder, the phasing mechanisms for the desmodromic drive mechanisms are shown associated with only one of these two types. The other type of valve is shown not to have phasing mechanisms, but could have them if appropriate. Idler sprockets for chain 174 are marked by the numeral 176.

Figure 28:
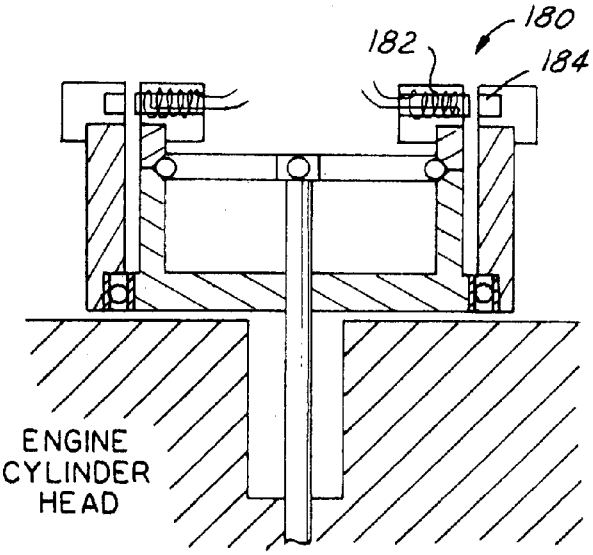
FIG. 28 is an elevation view, in cross section, of a desmodromic drive mechanism that provides variable phasing of valve operation by a stepper motor.
Figure 29:
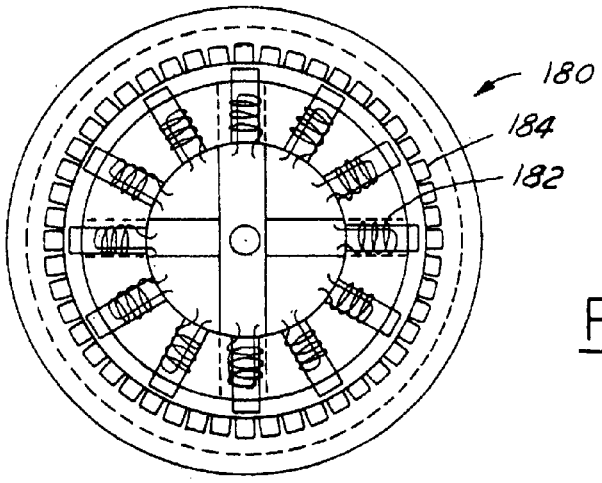
FIG. 29 is a full top plan view of FIG. 28.

FIGS. 28 and 29 show yet another embodiment that employs an electric stepper motor 180 in each desmodromic mechanism to change the valve phasing. The stator 182 of the motor is integrated with the follower guide. The motor rotor 184 is integrated with the cam ring. The stator is pulsed, or stepped, to step the rotor, and hence the follower guide and follower, relative to the cam ring about axis 42. Stepping can occur both clockwise and counterclockwise.

While a presently preferred embodiment has been illustrated and described, it is to be appreciated that the invention may be practiced in various forms within the scope of the following claims.

What is claimed is:

1. A desmodromic drive for imparting reciprocal translation to a translatable member comprising:

a ring that rotates about an axis;

a follower that reciprocates with axial motion along the axis as the ring rotates for imparting reciprocal translation to the member;

a coupling that causes the follower to reciprocate along the axis as the ring rotates and comprises an endless cam track on one of the ring and the follower and an element on the other of the ring and the follower that rides along the cam track as the ring rotates;

a follower guide for guiding the follower for axial motion along the axis;

and a feature that defines a circumferential relation of the follower to the follower guide about the axis, wherein the feature comprises a roller.

2. A desmodromic drive as set forth in claim 1 in which the roller constrains the follower against turning on the follower guide about the axis and comprises a circular cylinder that is supported for rotation about the cylinder axis.

3. A desmodromic drive as set forth in claim 2 in which the cylinder axis is perpendicular to the axis about which the ring rotates, the cylinder is carried by the follower, and the cylinder fits into a groove in the follower guide between confronting surfaces of the groove for rolling within the groove as the follower reciprocates.

4. A desmodromic drive as set forth in claim 2 in which the cylinder axis is tangential to an imaginary circle that is concentric with the axis about which the ring rotates, the cylinder is carried by the follower, and the cylinder rolls along a flat surface of the follower guide as the follower reciprocates.

5. A desmodromic drive as set forth in claim 1 in which the roller constrains the follower against turning on the follower guide about the axis and comprises a sphere.

6. A desmodromic drive as set forth in claim 5 in which the sphere is carried by the follower and rolls along a groove in the follower guide as the follower reciprocates.

7. A desmodromic drive as set forth in claim 6 including a spring bias mechanism for biasing the sphere toward the groove.

8. A desmodromic drive as set forth in claim 6 in which the groove is open is a direction facing radially toward the axis.

9. A desmodromic drive as set forth in claim 1 including the translatable member and a valve element which is translatable relative to a valve seat and to which the reciprocal translation imparted to the translatable member by the follower is imparted to the valve element, and a spring that spring-biases the translatable member relative to the follower to allow for lost-motion over-travel of the follower relative to the translatable member.

10. A desmodromic drive as set forth in claim 9 in which the spring comprises a spiral wave spring.

11. A desmodromic drive as set forth in claim 10 in which the spiral wave spring is arranged to increasingly contract in axial length in consequence of over-travel of the follower relative to the translatable member in one direction of reciprocation, and further including a further spiral wave spring arranged to increasingly contract in axial length in consequence of over-travel of the follower relative to the translatable member in an opposite direction of reciprocation.

12. A desmodromic drive as set forth in claim 1 including a valve element that is operated by the drive and closes against a valve seat concurrent with the element that rides along the cam track riding along a certain segment of the cam track, in which the follower comprises a central hub concentric with the axis and an arm that extends radially outward from the hub to the element that rides along the cam track, and in which the arm is arranged to flex as the element that rides along the cam track rides along the certain segment of the cam track and thereby cause the valve element to be forced against the seat when to the valve element closes against the seat.

13. A desmodromic drive as set forth in claim 1 in which the endless cam track is disposed on the ring and the element that rides along the cam track as the ring rotates is disposed on the follower.

14. A desmodromic drive as set forth in claim 13 in which the element that rides along the cam track as the ring rotates comprises a roller.

15. A desmodromic drive for imparting reciprocal translation to a valve element of a valve comprising:

a ring that rotates about an axis;

a follower that reciprocates with axial motion along the axis as the ring rotates for operating the valve element;

a coupling that causes the follower to reciprocate along the axis as the ring rotates and comprises an endless cam track on one of the ring and the follower and an element on the other of the ring and the follower that rides along the cam track as the ring rotates;

a follower guide for guiding the follower for axial motion along the axis;

a feature that defines a circumferential relation of the follower to the follower guide about the axis;

a valve stem through which the reciprocation of the follower imparts reciprocal translation to the valve element;

and a spring that spring-biases the stem relative to the follower to allow for lost-motion over-travel of the follower relative to the stem, wherein the spring comprises a spiral wave spring.

16. A desmodromic drive as set forth in claim 15 in which the spiral wave spring is arranged to increasingly contract in axial length in consequence of over-travel of the follower relative to the stem in one direction of reciprocation, and further including a further spiral wave spring arranged to increasingly contract in axial length in consequence of over-travel of the follower relative to the stem in an opposite direction of reciprocation.

17. A desmodromic drive as set forth in claim 15 in which the valve element comprises a valve of an internal combustion engine that opens a combustion chamber of the engine during a portion of an engine operating cycle.

18. A desmodromic drive for imparting reciprocal translation to a valve element of a valve relative to a valve seat of the valve comprising, in combination with the valve element and valve seat:

a ring that rotates about an axis;

a follower that reciprocates with axial motion along the axis as the ring rotates for operating the valve element;

a coupling that causes the follower to reciprocate along the axis as the ring rotates and comprises an endless cam track on one of the ring and the follower and an element on the other of the ring and the follower that rides along the cam track as the ring rotates; and a follower guide for guiding the follower for axial motion along the axis;

and a feature that defines a circumferential relation of the follower to the follower guide about the axis;

a stem through which the reciprocation of the follower imparts reciprocal translation to the valve element;

wherein the valve element closes against the valve seat concurrent with the element that rides along the cam track riding along a certain segment of the cam track, the follower comprises a central hub concentric with the axis and an arm that extends radially outward from the hub to the element that rides along the cam track, and the arm is arranged to flex as the element that rides along the cam track rides along the certain segment of the cam track and thereby cause the valve element to be forced against the valve seat when the valve element closes against the valve seat.

19. A desmodromic drive for imparting reciprocal translation to a translatable member comprising:

a ring that rotates about an axis;

a follower that reciprocates with axial motion along the axis as the ring rotates for imparting reciprocal translation to the member;

a coupling that causes the follower to reciprocate along the axis as the ring rotates and comprises an endless cam track on one of the ring and the follower and an element on the other of the ring and the follower that rides along the cam track as the ring rotates; and a follower guide for guiding the follower for axial motion;

wherein the follower comprises a central hub concentric with the axis and two pairs of arms that extend radially outward from the hub;

wherein a first pair of the arms extend in opposite directions to respective elements that ride along the cam track, and the cam track comprises two identical segments each running along a respective semicircumference of the ring;

wherein the follower guide comprises two axially extending grooves that are disposed facing and diametrically opposite each other about the axis and circumferentially between the two arms of the first pair;

and wherein each arm of a second pair of the arms extends from the hub toward a respective one of the two grooves of the follower guide and carries a respective sphere that is spring-biased radially outwardly of the axis to ride in the respective groove as the follower axially reciprocates.

20. A desmodromic drive as set forth in claim 19 in which the grooves are straight and parallel with the axis for constraining the follower from turning about the axis relative to the follower guide.

21. A desmodromic drive as set forth in claim 19 in which the translatable element comprises a stem of a valve of an internal combustion engine that opens a combustion chamber of the engine during a portion of an engine operating cycle, and further including a valve stem guide comprising a sleeve for guiding the valve stem and flange surrounding the sleeve, and a bearing assembly disposed on a flange supporting the ring for rotation about the axis.

* * * * *